US006941681B2

(12) United States Patent
Pritchett

(10) Patent No.: US 6,941,681 B2
(45) Date of Patent: Sep. 13, 2005

(54) WARMER FOR FEET AND TOES

(76) Inventor: Matthew W. Pritchett, 1935 Diamond Creek La., Aurora, IL (US) 60504

( * ) Notice: Subject to any disclaimer, the term of this patent is extended or adjusted under 35 U.S.C. 154(b) by 81 days.

(21) Appl. No.: 10/382,813

(22) Filed: Mar. 6, 2003

(65) Prior Publication Data

US 2004/0250445 A1 Dec. 16, 2004

(51) Int. Cl.[7] ..... A43B 7/02; A43B 7/34

(52) U.S. Cl. ..... 36/2.6; 36/77 R; 36/72 R; 36/96

(58) Field of Search ..... 36/2.6, 96, 7.1 R, 36/7.2, 71, 77 R, 70 R, 70 A, 72 R

(56) References Cited

U.S. PATENT DOCUMENTS

| | | | | | |
|---|---|---|---|---|---|
| 80,753 | A | * | 8/1868 | Marshall | 36/7.1 R |
| 1,355,382 | A | | 10/1920 | Blume | |
| 2,836,908 | A | * | 6/1958 | Altinger | 36/7.2 |
| 2,984,917 | A | | 5/1961 | Saunders | |
| 3,935,856 | A | | 2/1976 | Loftin | |
| 4,023,282 | A | | 5/1977 | Ziegelheafer | |
| 4,094,080 | A | | 6/1978 | Sanders | |
| 4,180,922 | A | | 1/1980 | Cieslak et al. | |
| 4,204,543 | A | | 5/1980 | Henderson | |
| 4,259,791 | A | * | 4/1981 | Bazan | 36/7.2 |
| 4,373,274 | A | | 2/1983 | Michalski | |
| 4,455,764 | A | | 6/1984 | Rock et al. | |
| 4,527,566 | A | | 7/1985 | Abare | |
| 4,536,975 | A | | 8/1985 | Harrell | |
| 4,538,368 | A | * | 9/1985 | Mugford | 36/7.1 R |
| 4,585,003 | A | | 4/1986 | Meistrell | |
| D284,615 | S | | 7/1986 | Rock et al. | |
| 4,688,572 | A | | 8/1987 | Hubbard et al. | |
| 4,788,780 | A | | 12/1988 | Boggs | |
| 4,823,426 | A | | 4/1989 | Bragga | |
| 4,841,646 | A | | 6/1989 | Maurer, Jr. | |
| D318,168 | S | | 7/1991 | Chilcutt | |
| 5,230,170 | A | | 7/1993 | Dahle | |
| 5,230,333 | A | | 7/1993 | Yates et al. | |
| 5,471,767 | A | | 12/1995 | Walker | |
| 5,787,607 | A | * | 8/1998 | Schurch | 36/7.1 R |
| 5,826,273 | A | | 10/1998 | Eckes | |

* cited by examiner

*Primary Examiner*—Anthony Stashick
(74) *Attorney, Agent, or Firm*—Grace J. Fishel

(57) ABSTRACT

A warming device for use in cold environments has a flexible pocket with at least one triangular side gusset for receiving a shoe or boot. The warming device has a receiver for receiving a heat generating packet or fuel stick heating device. The warming device may be firmly attached to a shoe or boot by constricting laces, cords or straps so that the gusset is pleated into loose folds along the side of the boot or shoe with heat generating packet or fuel stick heating device pressed substantially flat against the wearer's instep. The sole of the warming device may be modified to provide an anti-slip surface, for example, by installing studs in the sole. The sole of the warming device may be modified to adapt to specialized shoes or boots, such as ice skates.

17 Claims, 5 Drawing Sheets

WARMER FOR FEET AND TOES

BACKGROUND OF THE INVENTION

1. Field of the Invention

The present invention relates to a warming device for feet and toes to keep a user warm and comfortable for sports and outdoor activities as a participant or as a spectator.

2. Brief Description of the Prior Art

Cold weather and winter sports are very popular. Hunting, fishing, walking, hiking, game watching and camping are often at their best in cooler weather. In addition, athletic sports such as football, soccer, skiing and ice skating are done during the winter. These and other winter activities require protection from the cold with proper clothing to best enjoy the sport.

For a spectator, or an active participant, the feet and hands are most vulnerable to the cold. There have been many devices suggested to provide needed warmth to these areas including passive devices which provide additional insulation to hold the body's own heat and active devices which generate heat and apply the heat to the needed areas of the body.

U.S. Pat. Nos. D 284,615, D 318,168, 1,355,382, 2,984,917, 3,935,856, 4,023,282, 4,094,080, 4,180,922, 4,204,543, 4,373,274, 4,455,764, 4,788,780, 4,841,646, 5,230,170, 5,230,333, 5,471,767 and 5,826,273 are incorporated by reference herein.

BRIEF SUMMARY OF THE INVENTION

The present invention utilizes both passive and active heating of the extremities, in particular the feet and toes. In the present invention, an insulating covering is provided to fit over a boot or shoe and at least partially encompass the toe area of the boot and shoe. The insulating covering has a receiver or pocket to hold a heat generating device. A conventional heat generating device, such as an air activated heat generating packet or fuel stick heating device may be placed in the receiver.

The insulating covering has laces, cords or straps to firmly attach the insulating covering to the boot or shoe. The laces, cords or straps may be elastic and tensioned with a fastener. The insulating covering may be water repellent or waterproof, including being formed of a breathable fabric.

The sole of the insulating covering may be modified to fit specialized boots, such as ice skate boots. The sole may be further modified to provide an anti-slip surface, for example, by installing ice studs in the sole of the insulating covering.

It is thus an object of the invention to provide a warmer for feet and toes that can fit over a shoe or boot. The warmer provides insulation and additional heat when used with a heat generating packet or fuel stick heating device. It is another object to provide a warmer that can be firmly attached over a shoe or boot in a manner that the heat generating packet or fuel stick heating device lies substantially flat against the top of the wearer's foot. Other objects and features of the invention will be in part apparent and in part pointed out hereinafter.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
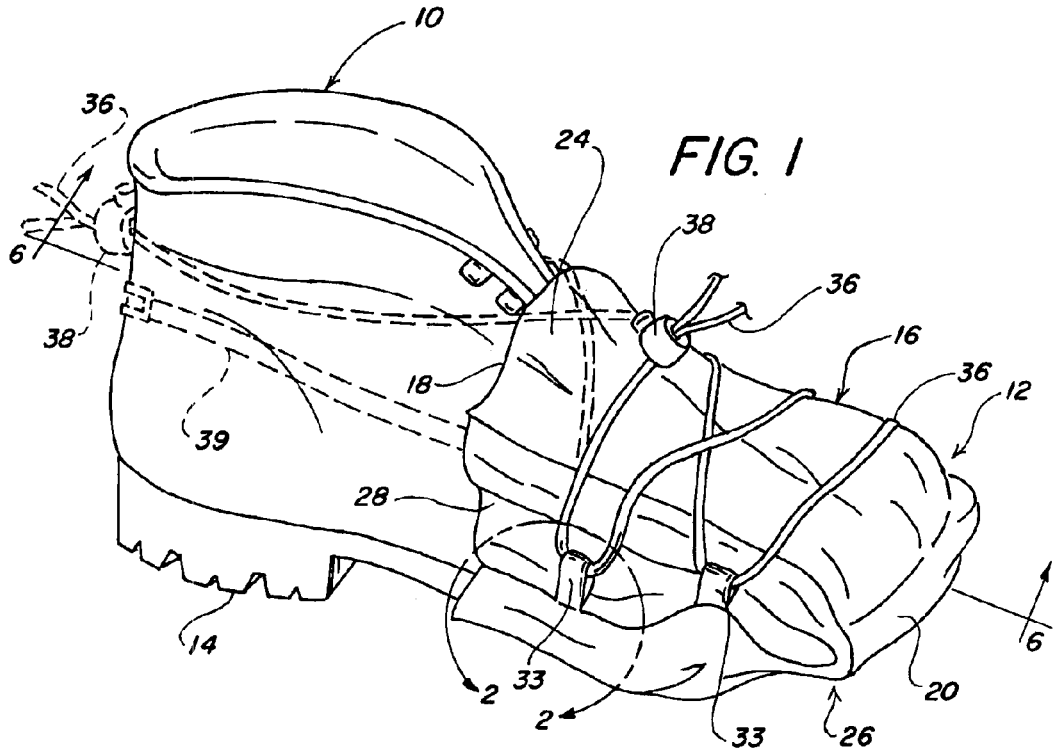
FIG. 1 is a perspective view of a boot having the warming device of the invention installed thereon.

Referring to FIG. 1, a shoe 10 is shown with a warming device of the invention 12 installed thereon. As illustrated, shoe 10 is a boot with a lugged sole 14. Warming device 12 is shown as an open pocket 16, having an open end 18 and a closed toe end 20, for enveloping the toe portion of boot or shoe 10. Warming device 12 has a sole portion 22 which is shown as fitting under lugged sole 14 of boot 10. Warming device 12 also has a top portion 24 which extends over toe portion 26 of boot 10.

Sole portion 22 and top portion 24 of warming device 12 meet and are joined at closed toe end 20 of warming device 12. Sole portion 22 and top portion 24 may be separate pieces or formed from a single strip of material. The sides of warming device 12 are formed as triangular gussets 28 best seen in FIG. 5. Triangular gussets 28 are oversized such that warming device 12 is loose fitting to accommodate boots and shoes of a range of sizes. When warming device 12 is installed on boot 10, as described further herein, gussets 28 are bunched or folded with top portion 24 of warming device 12 lying substantially flat against the top of boot 10 over a wearer's instep. Folded gussets 28 thus form insulating air pockets around boot 10 while admitting sufficient air for the continued generation of heat by heat generating packets received in warming device 12, as described herein.

Figure 4:
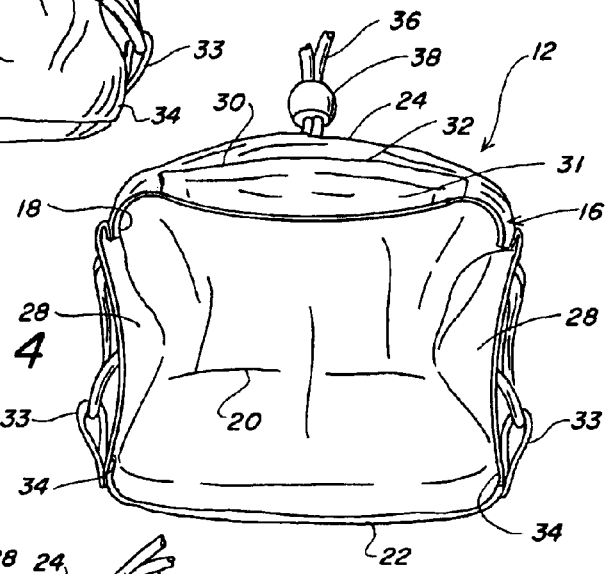
FIG. 4 is a back view of the warming device of the invention showing the receiver for the heat generating material.
Figure 6:
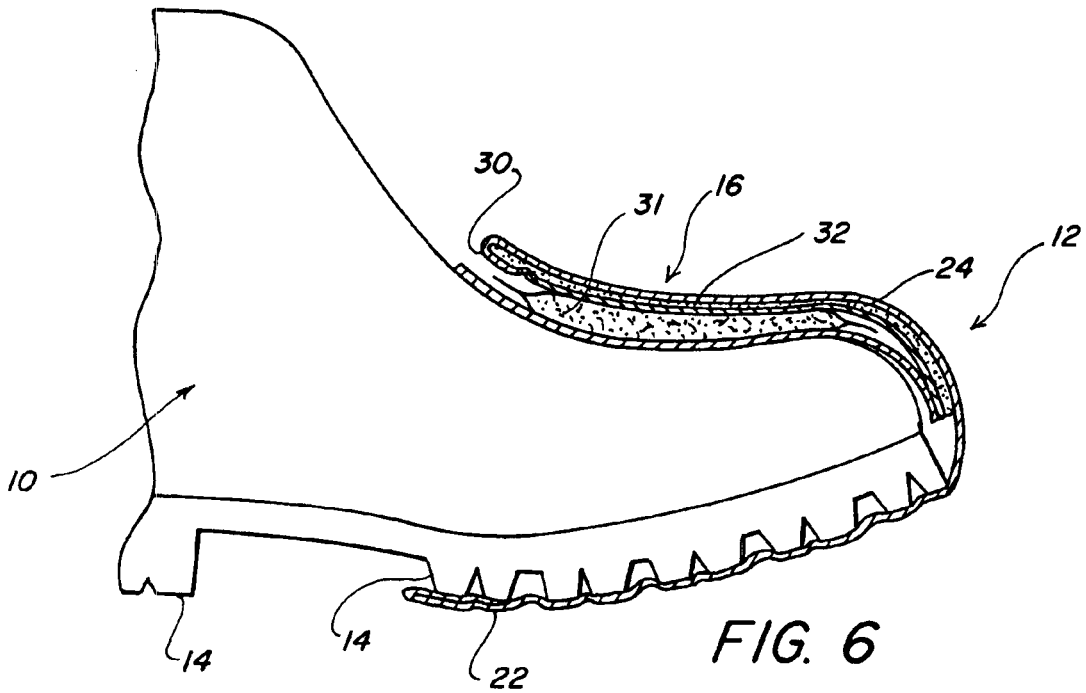
FIG. 6 is a partial cross-sectional view of the boot and warming device taken along the plane 6—6 in FIG. 1.
Figure 7:
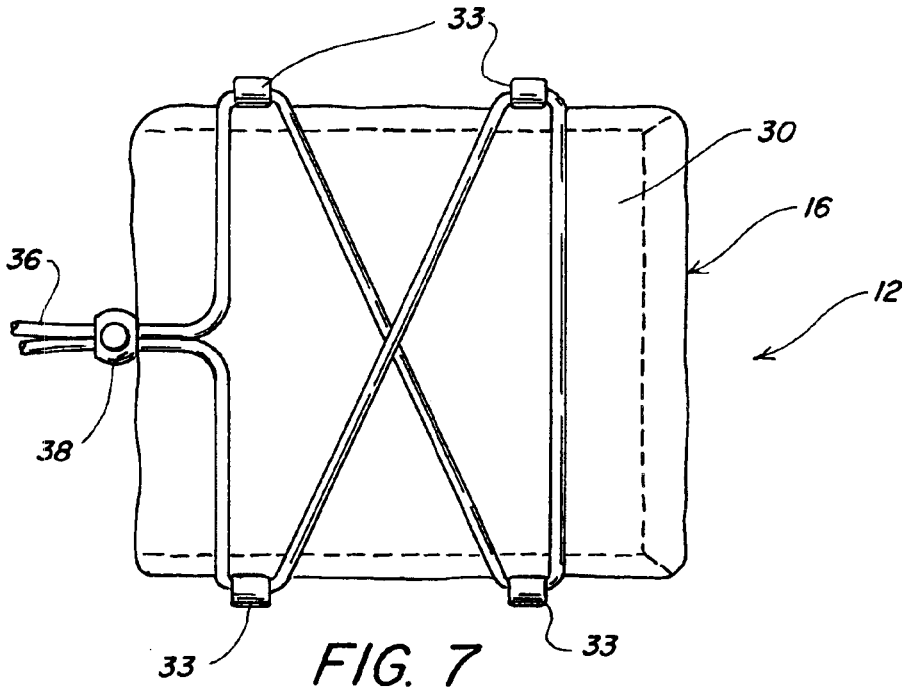
FIG. 7 is a top plan view of the warming device of the invention.
Figure 8:
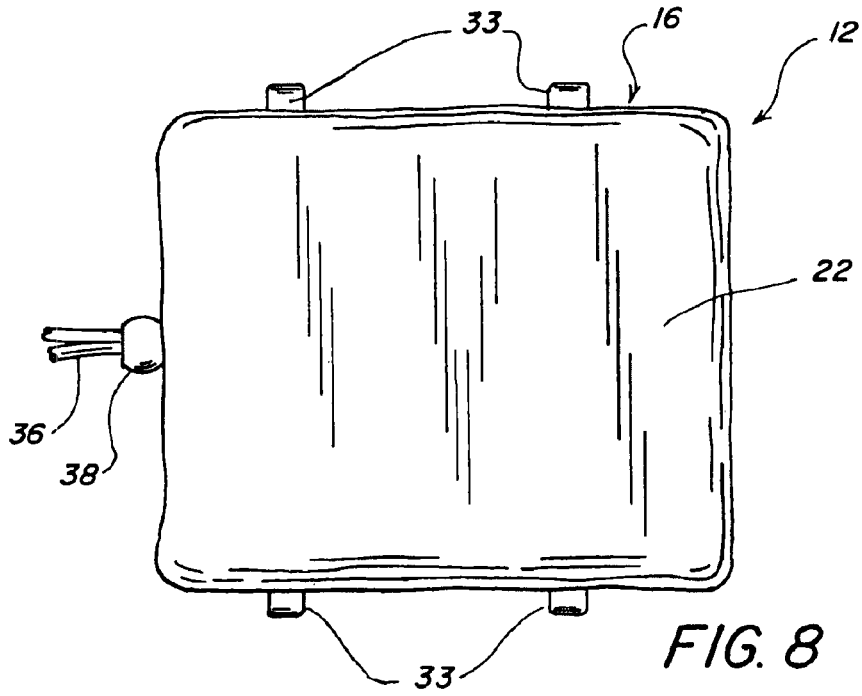
FIG. 8 is a bottom view of the warming device of the invention as shown in FIG. 7.

As shown in FIGS. 4 and 6, top 24 of warming device 12, has an inside pocket 30 for receiving a heat generating packet or fuel stick heating device 31. Top 24 of warming device 12 may be made of or may incorporate an insulating material 32 to hold the heat from heat generating packet or fuel stick heating device 31 and reduce the heat loss from the wearer's feet to the outside environment. It is also an advantage to make warming device 12, or at least top 24, out of water repellent or water proof material, such as Goretex (TM) or the like. The water repellent or water proof material shields heat generating packet or fuel stick heating device 31 from moisture. This is desirable because many conventional heat generating materials are damaged or destroyed by water. Wet boots are also much colder for the wearer due to increased heat loss from the body to the environment through the water.

Figure 5:
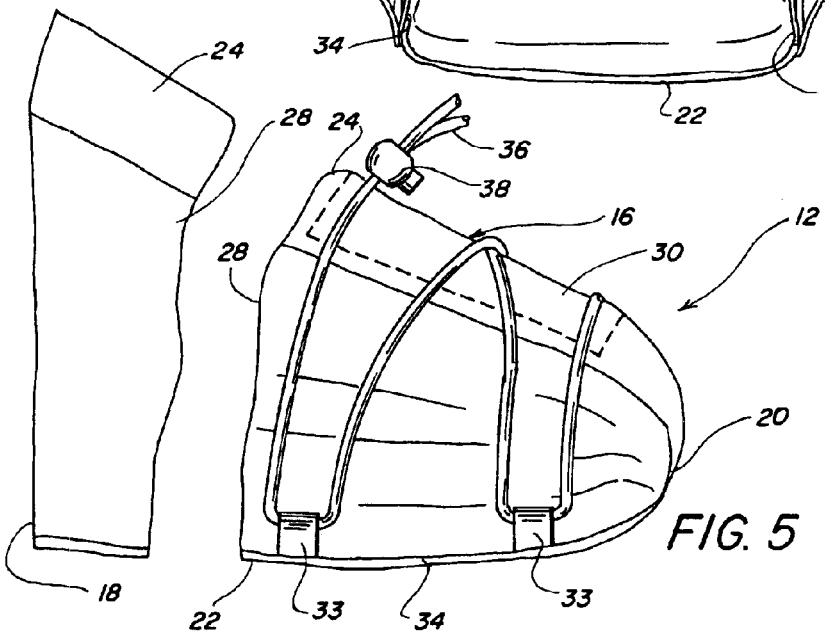
FIG. 5 is an exploded right side view of the warming device of the invention.

Warming device 12 may have a plurality of loops or eyelets 33, as shown in FIG. 5. Loops 33 are preferably located at a joint 34 between gussets 28 and soles 22, as shown. A lace or cord, such as an elastic cord 36, may be woven through loops 33. After cord 36 is tightened, it may be knotted or held in place by a fastener such as cord lock 38. A clip (not shown) may be attached to cord 36 between cord lock 38 and the knotted end and to the user's boot or shoe 10 or otherwise to his person. The purpose of the clip is to keep cord 36 neatly dressed and to retain warming device 12 if the warming device separates from the wearer's shoe or boot 10. At a preselected level of force, however, the clip should break away so that the wearer is not dragged or otherwise injured by warming device 12 or cord 36. This feature is important, for example, if the wearer is riding on a snowmobile and warming device 12 should become entangled in a track.

Figure 3:
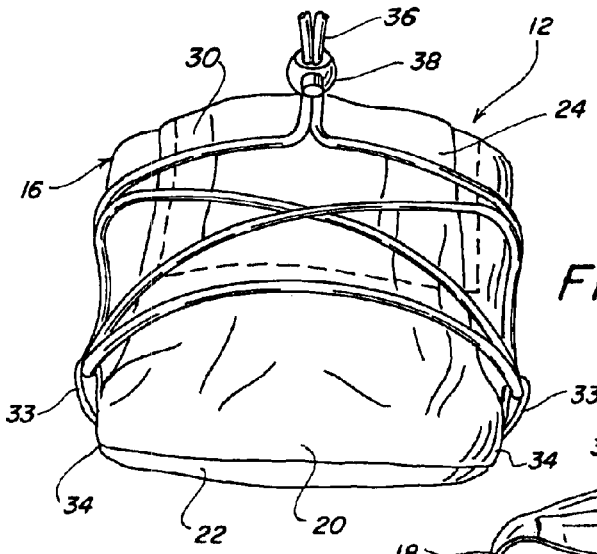
FIG. 3 is a front view of the warming device of the invention.

As shown in FIGS. 1, 3 and 5, cord 36 is held with fastener 38 over the instep of boot 10. It will be appreciated that cord 36 may also be placed around the heel of boot 10, as shown in phantom in FIG. 1. Warming device 12 may be outfitted with a strap 39 attached at open end 18 along top portion 24 or gussets 28, as shown in FIG. 1. Strap 39 provides more secure retainment of warming device 12 on shoe or boot 12 and may be desired, as for example if the wearer does extensive walking or climbing (e.g., ice fishing, climbing into a tree stand, etc.). Strap 39 may be elasticized or formed in two sections and made adjustable in length with a buckle or some other conventional fastener such that strap 39 fits snugly around the heel of boot 10.

Figure 2:
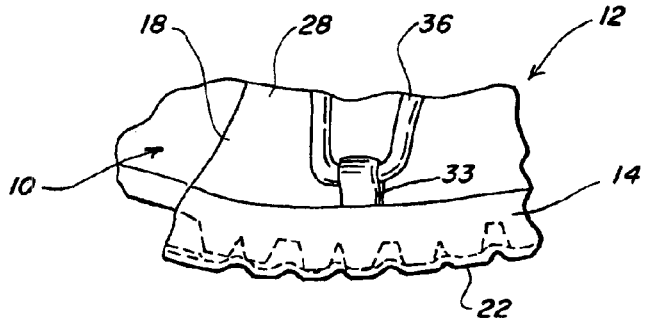
FIG. 2 is a detail view of the boot and warming device of FIG. 1 taken along line 2—2 in FIG. 1.

When cord 36 is tensioned, warming device 12 is held firmly on boot 10, as shown in FIG. 1, with heat generating packet or fuel stick heating device pressed substantially flat against the instep of boot 10 for best heat transfer to the wearer's body. Triangular gussets 28 are pleated in irregular folds against the sides of boot 10. Sole 22 of warming device 12 is tensioned against sole 14 of boot 10 by the pull of cord 36 on loops 33. If boot 10 has a lugged sole 14, as shown, or a sole with other indentations, projections, or cleats, sole 22 of warming device 12 is drawn into the spaces between the lugs, cleats, and the like as best seen in FIGS. 2 and 6. The tension on sole 22 thus aids in forming a secure attachment between boot 10 and warming device 12.

Many conventional heat generating packets and fuel stick heating devices 31 require air to function and it is therefore necessary for sufficient air to reach heat generating packets 31 in warming device 12 to maintain the evolution of heat from the heat generating packets. To this end, the material selected for warming device 12, when waterproof or water repellent, is preferably not air tight. The fit of warming device 12 to boot 10 is also not air tight with air channels purposefully left along folded gussets 28.

Figure 9:
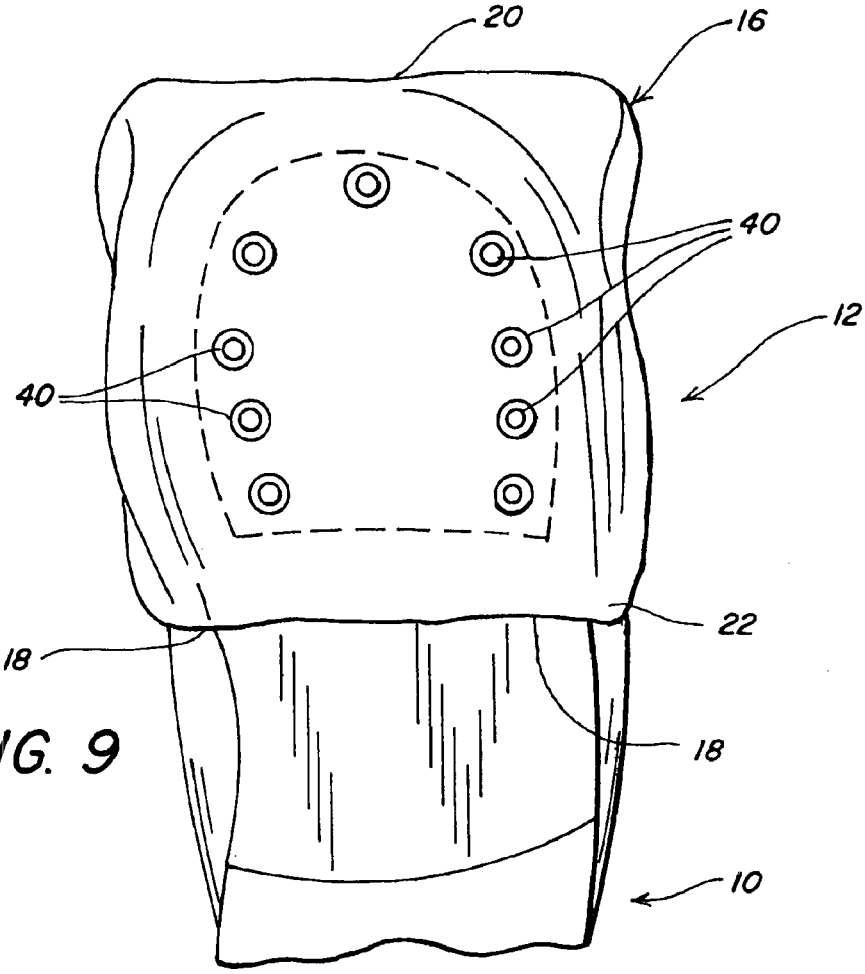
FIG. 9 is a bottom view of a further embodiment of the invention.

FIG. 9 shows a modification of the warming device 12. As shown, sole 22 of warming device 12 has a plurality of ice studs 40 installed thereon. Ice studs 40 may be particularly useful if the user of warming device 12 is ice fishing or otherwise in an icy environment.

Figure 10:
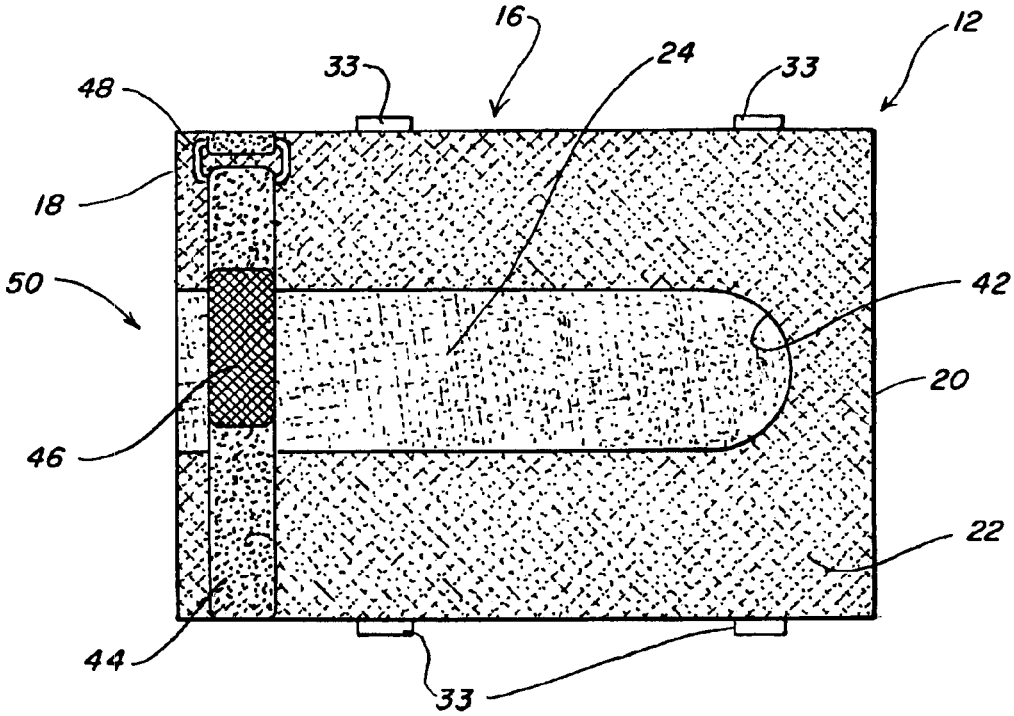
FIG. 10 is a bottom view of an additional embodiment of the invention.

FIG. 10 shows a further embodiment of warming device 12. Sole 22 of warming device 12 has a longitudinally extending slot 42 therein, as shown. Longitudinally extending slot 42 may receive the blade of an ice skate, a cross-country ski binding, or the like. A strap 44 can be passed under a skate boot, or the like, and assist in fastening warming device 12 to the boot. An end 46 of strap 44 may be passed through a buckle loop 48 and secured by hook and loop fasteners 50, such as Velcro (TM) fasteners, or by another conventional fastener. If desired, the modified warming devices 12 of FIGS. 9 and 10 may also have the loop and cord tensioning structure described above.

It will be appreciated that warming device 12 may be constructed of a variety of conventional materials and by a variety of conventional methods. A durable and flexible material, for example a sturdy pack cloth, such as Cordura Nylon (TM) has been found satisfactory but other materials may be used. The warming device of the invention may be constructed from this material by sewing, for example.

It will also be appreciated by those skilled in the art that the embodiments disclosed herein are illustrative. The disclosed invention may be modified further without departing from the spirit of the invention. For example, other conventional materials, such as a plastic sheet if sufficiently breathable, may be used in the disclosed structure. Other conventional methods of fabrication may also be used, for example molding or welding. Other equivalent methods of tensioning the warming device and attaching the warming device to a boot or shoe may be used, for example, straps and buckles.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A warming device for feet and toes comprising a flexible envelope having a closed end and an open end, the open end being adapted to receive a toe portion of a boot or shoe therein, the envelope being oversized to loosely encompass a boot or a shoe received therein, the envelope having a top surface, a sole, and at least one triangular side piece, the top surface and sole having an edge joining with the triangular side piece, said top surface and sole lying substantially flat against a toe portion of the boot or shoe therein and said triangular side piece lying bunched or folded against a side portion of the boot or shoe therein, the warming device having a plurality of loops positioned along the edge of the sole, the warming device having a cord woven through the loops, the warming device having a receiver thereon for receiving a heat generating member of the kind requiring air for the continued generation of heat, the receiver being located in the top surface of the warming device and extending over the toe portion of a boot or shoe received in the envelope, whereby the cord may be tensioned to firmly attach the warming device to the toe portion of a boot or shoe received therein.

2. The warming device of claim 1 wherein the warming device is water repellent.

3. The warming device of claim 1 wherein the warming device is waterproof.

4. The warming device of claim 1 wherein the warming device is constructed of a breathable waterproof material.

5. The warming device of claim 1 wherein the warming device has an insulating material therein to minimize the heat loss to a surrounding environment.

6. The warming device of claim 5 wherein the insulating material is placed over the receiver for a heat generating member.

7. The warming device of claim 1 wherein the cord is elastic and the tension on the cord is held by a fastener.

8. The warming device of claim 1 wherein the sole has studs serving as anti-slip elements thereon.

9. The warming device of claim 1 wherein the sole has a longitudinal slot therein, the longitudinal slot being adapted to receive the blade of an ice skate, the slot being closed by a strap and fastener.

10. A warming device for feet and toes comprising a flexible envelope having a closed end and an open end, the open end being adapted to receive a toe portion of a boot or shoe therein, the envelope being oversized to loosely encompass a boot or a shoe received therein, the envelope having a top surface, a sole, and a plurality of triangular side pieces, the top surface and sole having an edge joining with the triangular, side pieces, said top surface and sole lying substantially flat against a toe portion of the boot or shoe therein and said triangular side piece lying bunched or folded against a side portion of the boot or shoe therein, the warming device having a plurality of loops positioned along the edge of the sole, the warming device having a cord woven through the loops, the cord having an adjustable fastener thereon, the warming device having a receiver thereon for receiving a heat generating member of the kind requiring air for the continued generation of heat, the receiver being located in the top surface of the warming device and extending over the toe portion of a boot or shoe received in the envelope, whereby the cord may be tensioned and the tension held by the fastener to firmly attach the warming device to the toe of a boot or shoe received therein.

11. The device of claim 10 wherein the device is constructed of a sturdy packcloth.

12. The device of claim 10 wherein the device is constructed of a breathable packcloth.

13. The device of claim 10 wherein the cord is elastic.

14. The device of claim 10 wherein the device has an insulating material placed over the receiver for a heat generating member to minimize the loss of heat to a surrounding environment.

15. The device of claim 10 wherein the sole has studs serving as an anti-slip surface.

16. The device of claim 10 wherein the sole has a longitudinal slot to receive the blade of an ice skate.

17. The device of claim 16 wherein the longitudinal slot is closed by a strap and fastener.

* * * * *